US005291166A

United States Patent [19]

Chikira

[11] Patent Number: 5,291,166

[45] Date of Patent: Mar. 1, 1994

[54] ELECTROMAGNETIC RELAY WITH RESISTOR AND METHOD FOR MANUFACTURING THE SAME

[75] Inventor: Toru Chikira, Yokohama, Japan

[73] Assignee: Jidosha Denki Kogyo Kabushiki Kaisha, Kanagawa, Japan

[21] Appl. No.: 990,094

[22] Filed: Dec. 14, 1992

[30] Foreign Application Priority Data

Dec. 16, 1991 [JP] Japan ..... 3-332144

[51] Int. Cl.[5] ..... H01H 51/22

[52] U.S. Cl. ..... 335/78; 335/83; 335/202

[58] Field of Search ..... 35/78-86, 35/124, 128, 202

[56] References Cited

U.S. PATENT DOCUMENTS 4,761,627 8/1988 Bell ..... 335/128

4,801,908 1/1989 Weaver ..... 335/80

*Primary Examiner*—Lincoln Donovan

*Attorney, Agent, or Firm*—Sughrue, Mion, Zinn, Macpeak & Seas

[57] ABSTRACT

An electromagnetic relay with a resistor is manufactured through the process comprising the steps of assembling an actuating part of the relay having a coil, contacts, terminals, an armature, a core and the like, setting the resistor on a base having slots to receive the terminals, and mounting the actuating part of the relay on the base by inserting the terminals into the slots of the base. The resistor is connected to coil terminals connected with the coil by fitting lead wires of the resistor into slits formed in the respective coil terminals so as to open in the inserting direction of the terminals at the same time of mounting the actuating part of the relay.

5 Claims, 12 Drawing Sheets

ELECTROMAGNETIC RELAY WITH RESISTOR AND METHOD FOR MANUFACTURING THE SAME

BACKGROUND OF THE INVENTION

1. Field of the Invention

This invention relates to an electromagnetic relay used for opening and closing a circuit by operating an armature according to an excitation of a coil, and more particularly to an electromagnetic relay with a built-in resistor for protecting its electromagnetic coil from surge current and a method for manufacturing the electromagnetic relay with the built-in resistor.

2. Description of the Prior Art

Heretofore, there has been used an electromagnetic relay disclosed in U.S. Pat. No. 5,003,274, for example.

The electromagnetic relay is provided with a coil(7), armature(9), connected with a resilient member(10) having a movable contact(11), terminals(5 and 6) having respective fixed contacts(3 and 4), and a resistor R for absorbing surge voltage generated at the time of shutting off the power supply to a coil(7) through terminals(14 and 15), and is so structured as to open a circuit connected between the terminal(5) and a terminal(13) connected with the movable contact(13), and close another circuit connected between the terminal(6) and the terminal(13) according to excitation of the coil(7) by supplying the electric current to the coil(7).

However, in the conventional electromagnetic relay described above, the resistor R is disposed on the terminals(14 and 15) and it is necessary to connect lead wires of the resistor R with both ends of a wound wire(7*a*) of the coil(7), respectively. Therefore, there is a problem since it is troublesome to connect the resistor with the terminals and the both ends of the wound wire of the coil, and it is difficult to rationalize the manufacturing process of the electromagnetic relay of this kind.

SUMMARY OF THE INVENTION

This invention is made in view of the aforementioned problem of the conventional electromagnetic relay having the resistor, it is an object to provide an electromagnetic relay which is possible to reduce manpower required for connecting its built-in resistor and a method for manufacturing the electromagnetic relay which is possible to rationalize the process for mounting the resistor.

The construction of the electromagnetic relay according to this invention for attaining the aforementioned object is characterized in that coil terminals connected with respective ends of a wound wire of a coil is attached on a base in a state of inserting their legs into coil terminal slots provided in the base, and a resistor is disposed between the base and the coil terminals at a state in which lead wires of the resistor are connected to the coil terminal by fitting the lead wires into slits formed in the respective coil terminals so as to open in the protruding direction of the legs of the coil terminals.

The construction of the method for manufacturing the electromagnetic relay for attaining the aforementioned object is characterized by comprising the steps of assembling an actuating part of the electromagnetic relay having a coil, an armature, a movable contact connected with the armature through a resilient piece fixed on a frame, a pair of coil terminals and so on, setting a resistor on a base provided with coil terminal slots to receive the coil terminal and a fixed contact, and connecting the resistor with the coil terminals simultaneously with mounting the actuating part of the relay on the base by inserting the coil terminals into the coil terminal slots and fitting lead wires of the resistor on the base into slits formed in the respective coil terminals so as to open in the inserting direction of the coil terminals.

Therefore, the lead wires of the resistor are fitted in the slits of the respective coil terminals to be connected with the coil terminals at the same time the coil terminals are inserted into the coil terminal slots of the base and the actuating part of the electromagnetic relay is mounted on the base, so that the process for mounting the resistor in the electromagnetic relay is rationalized.

DESCRIPTION OF THE PREFERRED EMBODIMENT

Figure 1:
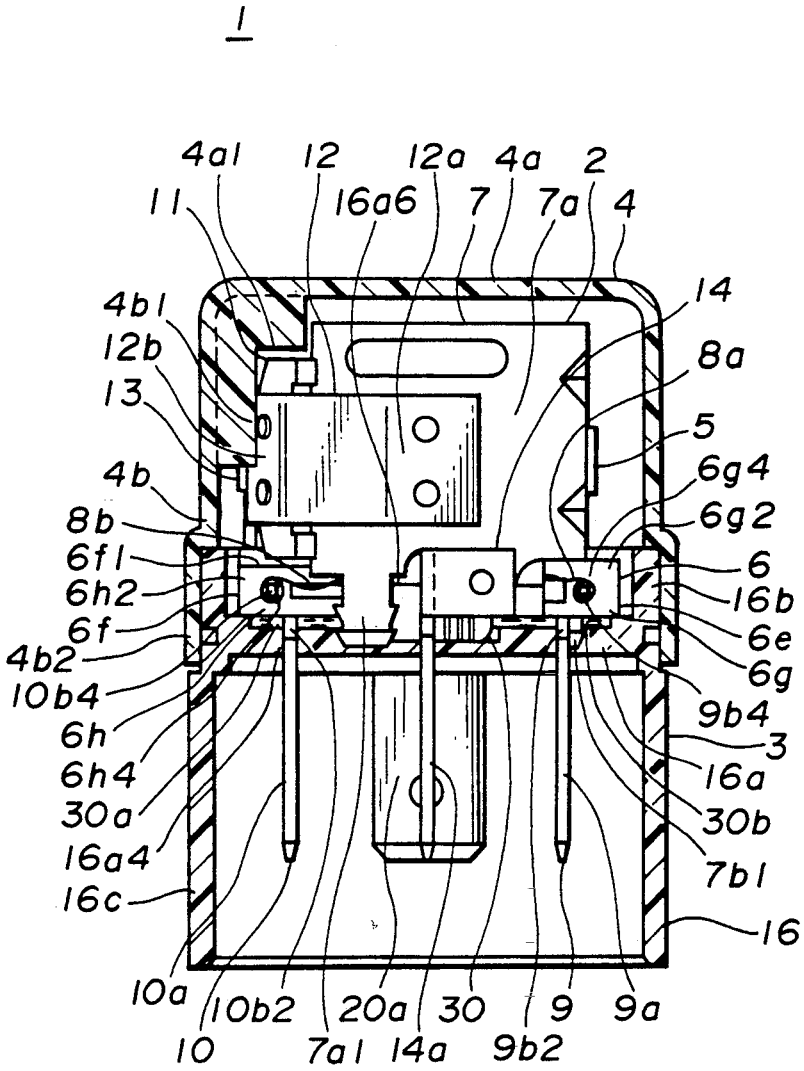
FIG. 1 is a sectional front elevation illustrating the electromagnetic relay according to an embodiment of this invention.

An embodiment of the electromagnetic relay according to his invention will be described below on basis of FIG. 1 to FIG. 18.

An electromagnetic relay 1 shown in the figures is composed mainly of an actuating part 2, a base 3 and a case 4.

The actuating part 2 is composed of a iron core 5, a bobbin 6, a frame 7, a coil 8, coil terminals 9 and 10, an armature 11, a resilient piece 12, a movable contact 13 and a movable contact terminal 14.

Figure 9:
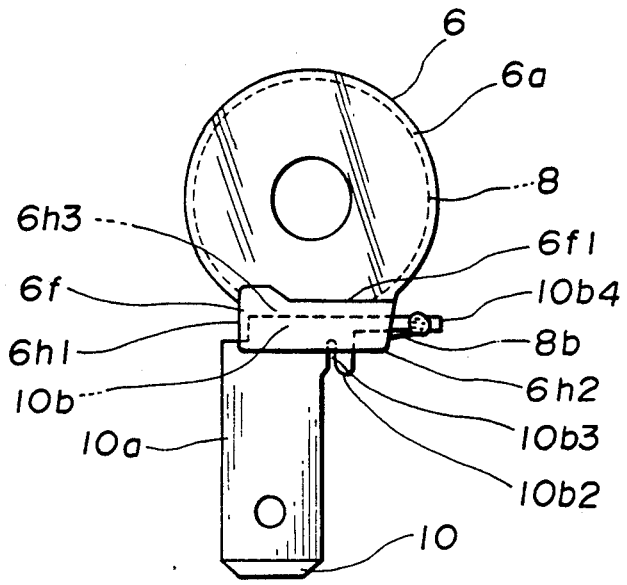
FIG. 9 is a left side elevation illustrating the bobbin and the coil terminal of the electromagnetic relay shown in FIG. 1.
Figure 10:
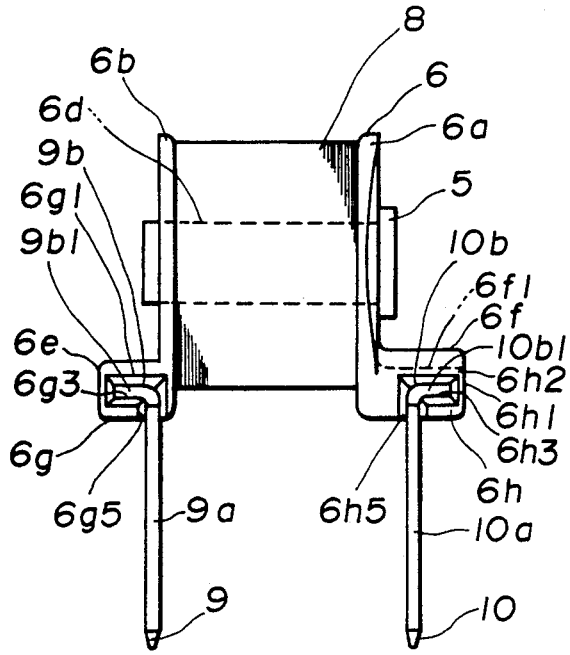
FIG. 10 is a rear elevation illustrating the bobbin, the coil and the coil terminals of the electromagnetic relay shown in FIG. 1.

The bobbin 6 is provided with a cylindrical part 6*c* to be formed with the coil 8 between flanges 6*a* and 6*b*, and provided with a core hole 6*d* to be inserted with the iron core 5 in center points of the flanges 6*a* and 6*b* as shown in FIGS. 9–12. The bobbin 6 is formed with the coil 8 by winding a copper wire around the cylindrical part 6*c*, and inserted with the iron core 5 in the core hole 6*d* thereof, as shown in FIG. 10.

The bobbin 6 is provided with base blocks 6*e* and 6*f* on the outsides of the respective flanges 6*a* and 6*b*, and the base blocks 6e and 6f are formed with terminal fixative parts 6g and 6h. Furthermore, one of two base blocks 6e and 6f, that is the base block 6f is provided with a restrictive face 6f1 on the upper face thereof so as not to cause the armature 11 to slip from the proper position by restricting the armature 11 between the restrictive face 6f1 and other restrictive faces 4a1 and 4b1 formed on the case 4 (will be described later) even if the relay 1 receives an impact from one cause or another.

Figure 11:
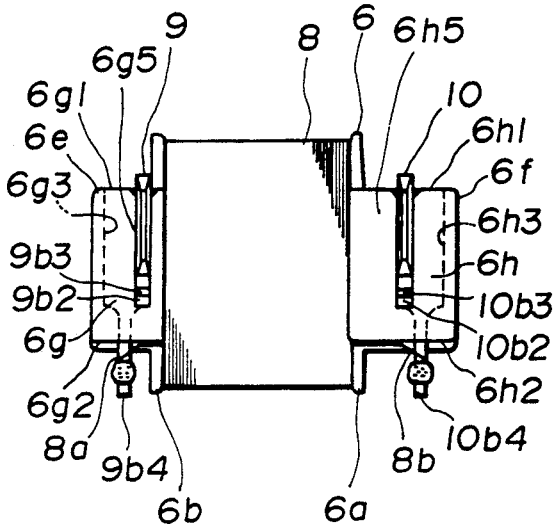
FIG. 11 is a bottom view of the bobbin and the coil shown in FIG. 10.
Figure 12:
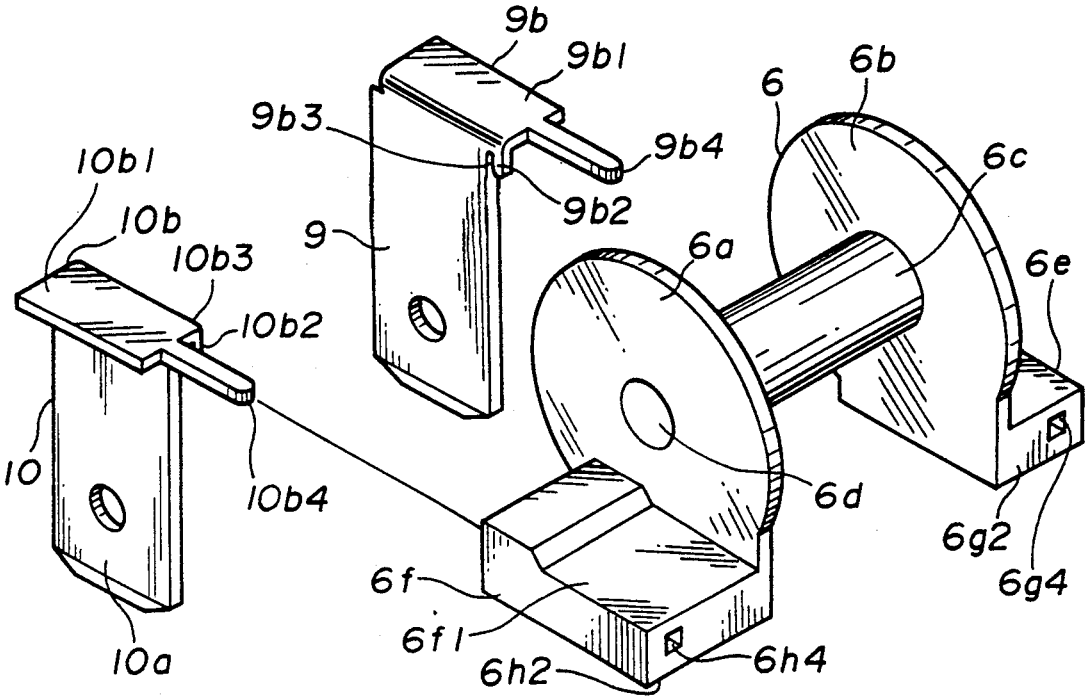
FIGS. 12 to 18 are perspective views illustrating the assembling process of the electromagnetic relay shown in FIG. 1.

The terminal fixative parts 6g and 6h is formed with terminal holder grooves 6g3 and 6h3 having L-shaped sections and piercing through the terminal fixative parts 6g and 6h from rear faces 6g1 and 6h1 (upper side in FIG. 11) to front faces 6g2 and 6h2 (lower side in FIG. 11). The terminal holder grooves 6g3 and 6h3 open on the rear faces 6g1 and 6h1, and have small square apertures 6h4 and 6h4 on the front faces 6g2 and 6h2 of the terminal fixative parts 6g and 6h as shown in FIG. 12. Furthermore, the terminal holder grooves 6g3 and 6h3 have cutouts 6g5 and 6h5 on the lower face of the terminal fixative parts 6g and 6h so as to protrude leg parts 9a and 10a of the coil terminals 9 and 10.

The bobbin 6 is attached with the coil terminals 9 and 10 in the terminal fixative parts 6g and 6h.

The coil terminals 9 and 10 have L-shaped sections, and composed of inset portions 9b and 10b and legs 9a and 10a bending orthogonally and protruding from the inset portions 9b and 10b so as to be connected with an external circuit (not shown) as shown in FIGS. 9–12. The inset portions 9b and 10b are provided with projections 9b2 and 10b2 projecting parallel with the legs 9a and 10a from inset pieces 9b1 and 10b1 having external shapes suitable to be inserted in the terminal holder grooves 6g3 and 6h3 of the bobbin 6. The coil terminals 9 and 10 are provided with slits 9b3 and 10b3 opening in the protruding direction of the legs 9a and 10a for receiving lead wires 30a and 30b of a resistor 30 (will be described later) between the projections 9b2, 10b2 and the legs 9a, 10a, respectively. The slits 9b3 and 10b3 of the coil terminals 9 and 10 have widths slightly smaller than outer diameters of the lead wires 30a and 30b of the resistor 30.

The inset portions 9b and 10b of the coil terminals 9 and 10 are also provided with long projections 9b4 and 10b4 extending from the inset pieces 9b1 and 10b1 as shown in FIGS. 9, 11 and 12, the projections 9b4 and 10b4 are so designed as to poke through the base blocks 6e and 6f of the bobbin 6, and stick out from the square apertures 6g4 and 6h4 of the terminal holder grooves 6g3 and 6h3 of the bobbin 6.

The coil terminals 9 and 10 are supported by the terminal fixative parts 6g and 6h of the bobbin 6 at the state in which the projections 9b4, 10b4 stick out from the square apertures 6g4, 6h4 and the legs 9a, 10a protrude downwardly from the cutouts 6g5, 6h5 of the lower face of the terminal fixative parts 6g, 6h of the bobbin 6 together with the projection 9b2, 10b2 forming the slits 9b3, 10b3, by inserting the inset portions 9b and 10b of the coil terminals 9 and 10 into the terminal holder grooves 6g3 and 6h3 with the projections 6g4, 6h4 at the head. The long projections 9b4 and 10b4 poking through the base blocks 6e and 6f and sticking out from the square apertures 6g4 and 6h4 are bound with respective end portions 8a and 8b of the wound wire of the coil 8 and connected with solder, whereby the coil 8 is connected with the coil terminals 9 and 10. The soldered joints act so as not to disengage the inset portions 9b and 9a from the terminal holder grooves 6g3 and 6h3, therefore the coil terminals 9 and 10 never fall out from the bobbin 6 so easily.

Additionally, as shown in FIG. 9, the long projection 9b4 of the coil terminal 9 (similarly to the projection 10b4 of the coil terminal 10) is so designed that the point to be soldered may be located at a position forward from the line A passing the front edge of the leg 9a of the coil terminal 9 on the side of the projection 9b4 and being in contact with an outer periphery of the flange 6a of the bobbin 6. Accordingly, the coil bobbin 6 and the legs 9a, 10a of the coil terminals 9, 10 are never dipped in a solderbath even when the projections 9b4, 10b4 are dipped into the solder bath in order to solder the projections 9b4, 10b4 of the coil terminals 9, 10 with the respective both ends 8a, 8b of the wound wire of the coil 8.

Figure 3:
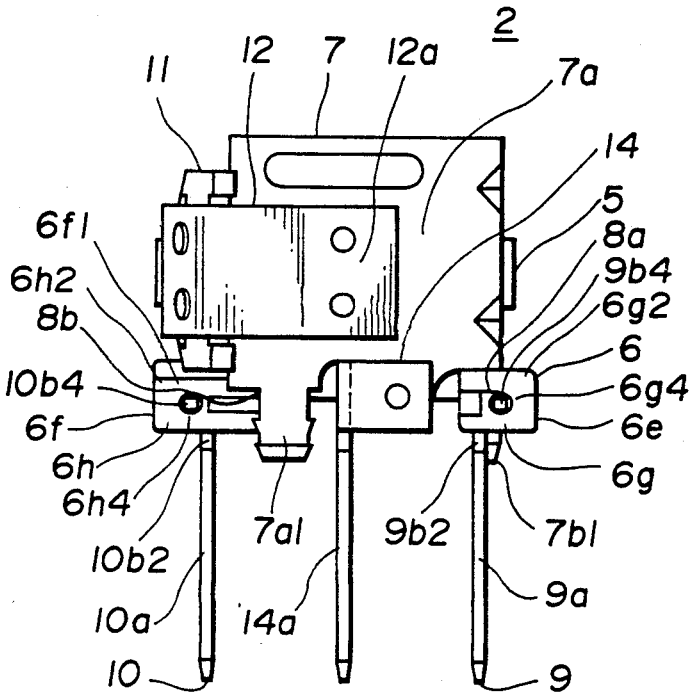
FIG. 3 is a front elevation illustrating the actuating part of the electromagnetic relay shown in FIG. 1.
Figure 4:
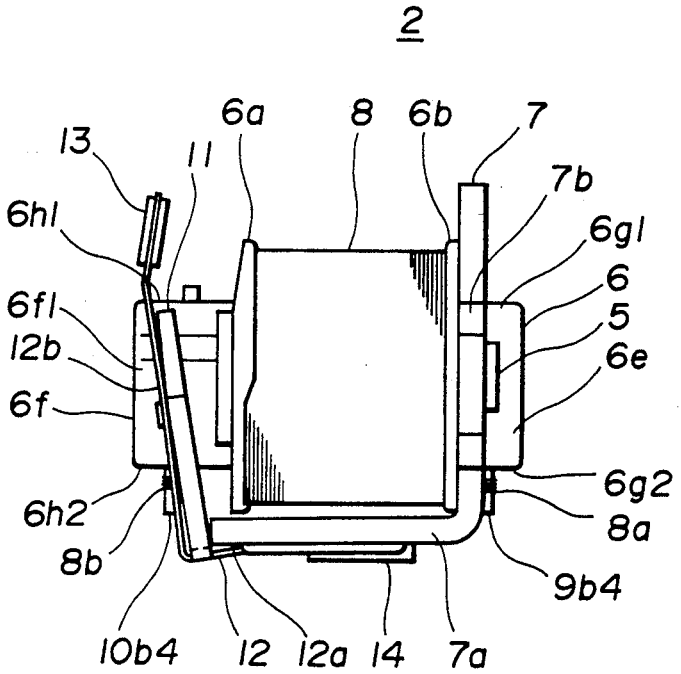
FIG. 4 is a top view of the actuating part shown in FIG. 3.
Figure 14:
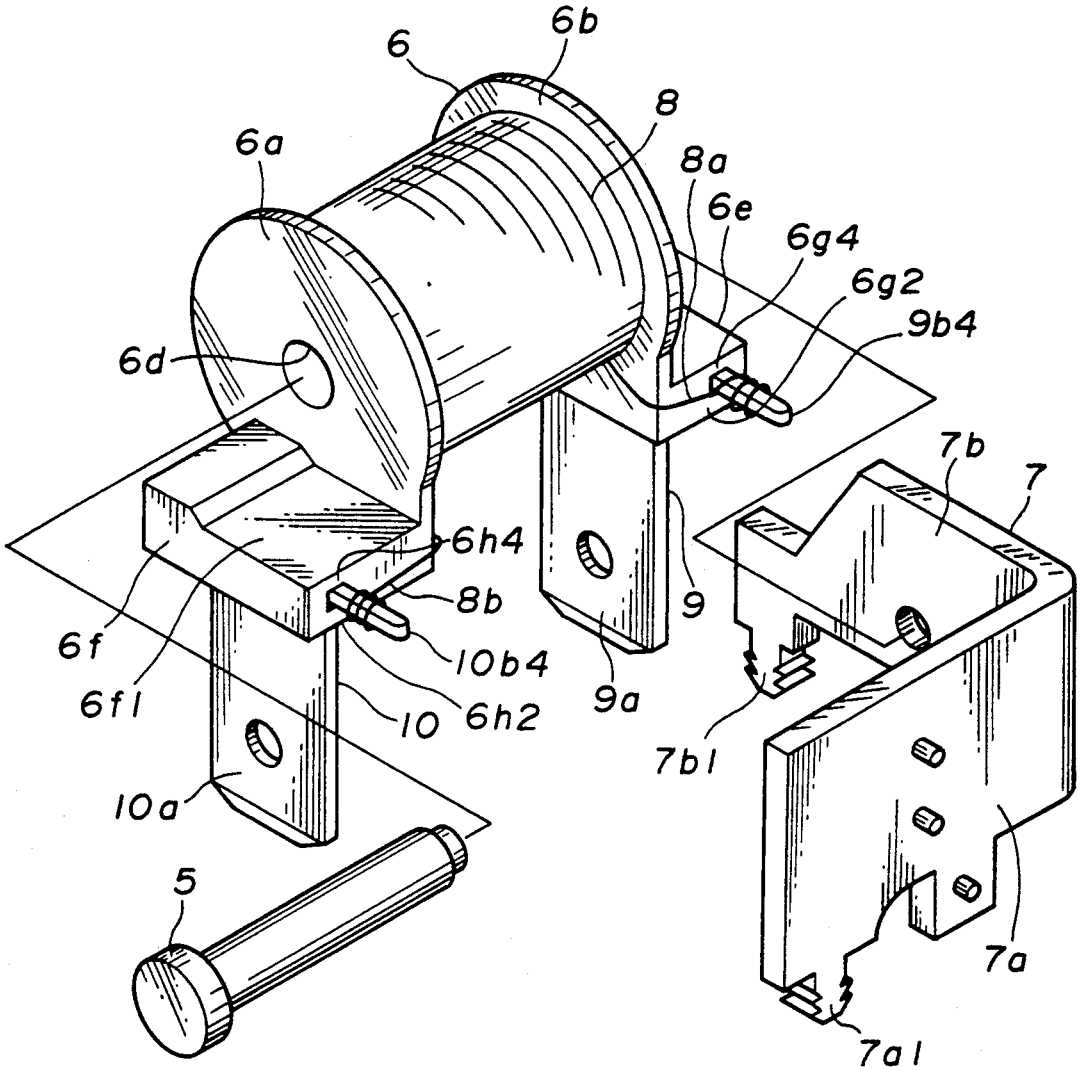

The frame 7 is secured with an end of the iron core 5 pierced through the core hole 6d of the bobbin 6. The frame 7 is made of magnetic substance with electric conductivity, has a L-shaped section as shown in FIGS. 3, 4 and 14, and composed of an armature-side part 7a to be fixed with the resiliend piece 12 attached with the armature 11 and a core-side part 7b to be secured with the iron core 5.

The armature-side part 7a and the core-side part 7b of the frame 7 are provided with press-fitting projections 7a1 and 7b1 to be pressed into the press-fitting holes 16d and 16e formed in the base 3 which will be described later. The armature-side part 7a is fixed with a movable contact terminal 14 having a leg 14a protruding downwardly as shown in FIG. 3 so as to be connected with an external circuit at a lower center part thereof. Furthermore, the core-side part 7b of the frame 7 is secured with the iron core 5 in the center part thereof as described above, and the armature-side part 7a is fixed with base end 12a of the resilient piece 12 by caulking in the center part thereof.

The resilient piece 12 is formed by bending elastic material with electric conductivity into a L-shape, and so designed as to fix on the armature-side part 7a at the base and 12a thereof and as to move at the moving part 12b extending toward the iron core 5 from the armature-side part 7a of the frame 7. Furthermore, the resilient piece 12 is disposed with the armature 12 formed of magnetic substance in the middle of the moving part 12b by caulking, attached with a movable contact 13 at another end thereof, and energizes the armature 11 and the movable contact 13 in the direction away from the iron core 5 at a state in which the armature 11 is in contact with the edge of the armature-side part 7a of the frame 7.

On the other side, the base 3 is composed of a base body 16, fixed contact terminals 19 and 20 provided with fixed contacts 17 and 18, respectively.

Figure 5:
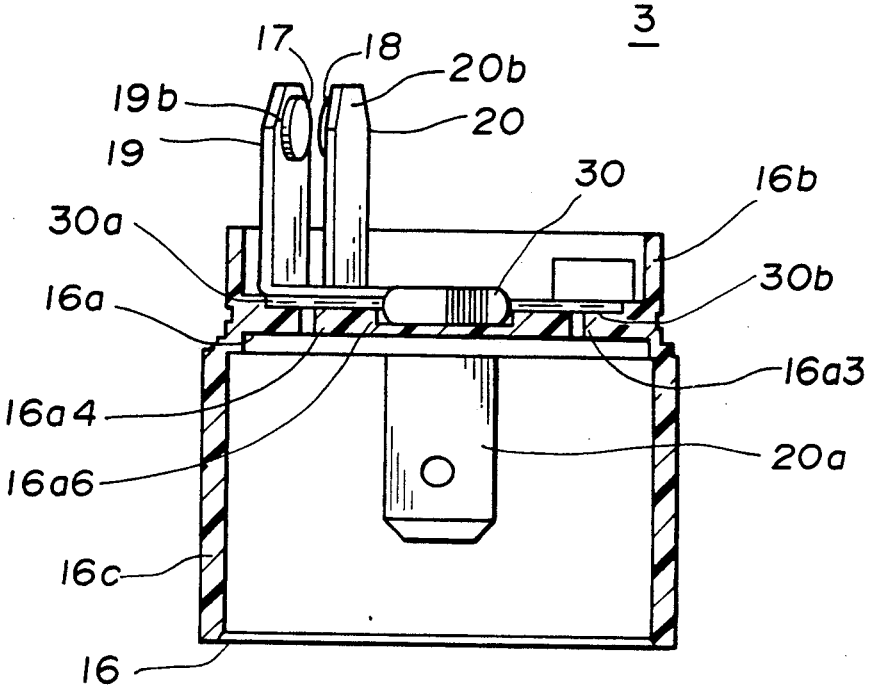
FIG. 5 is a sectional front elevation illustrating the base of the electromagnetic relay shown in FIG. 1.
Figure 6:
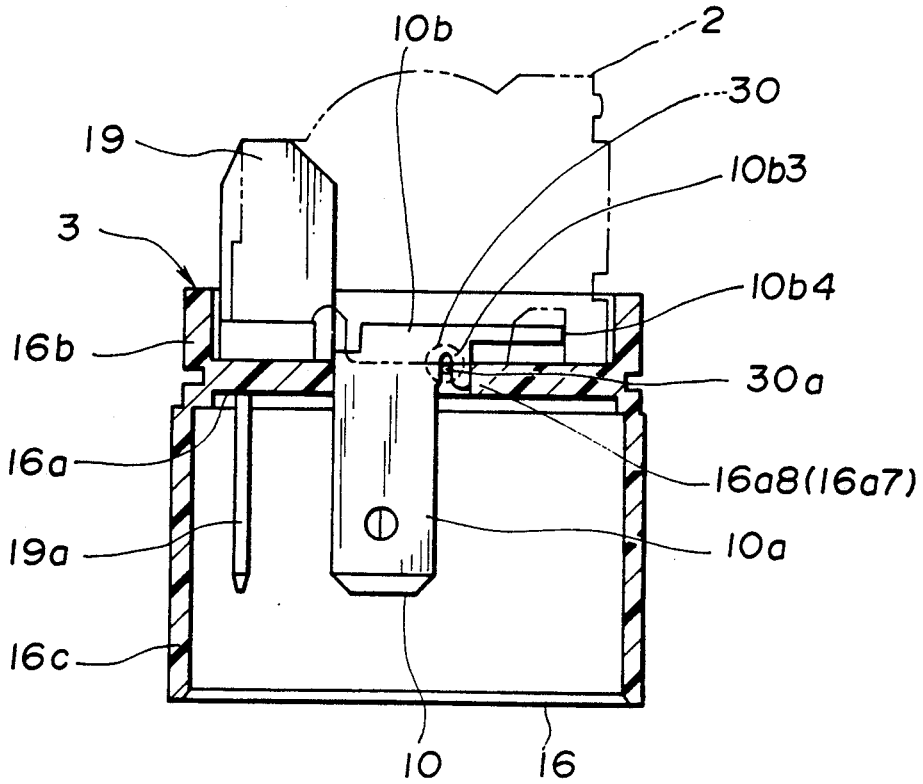
FIG. 6 is a sectional side elevation of the base shown in FIG. 5.
Figure 17:
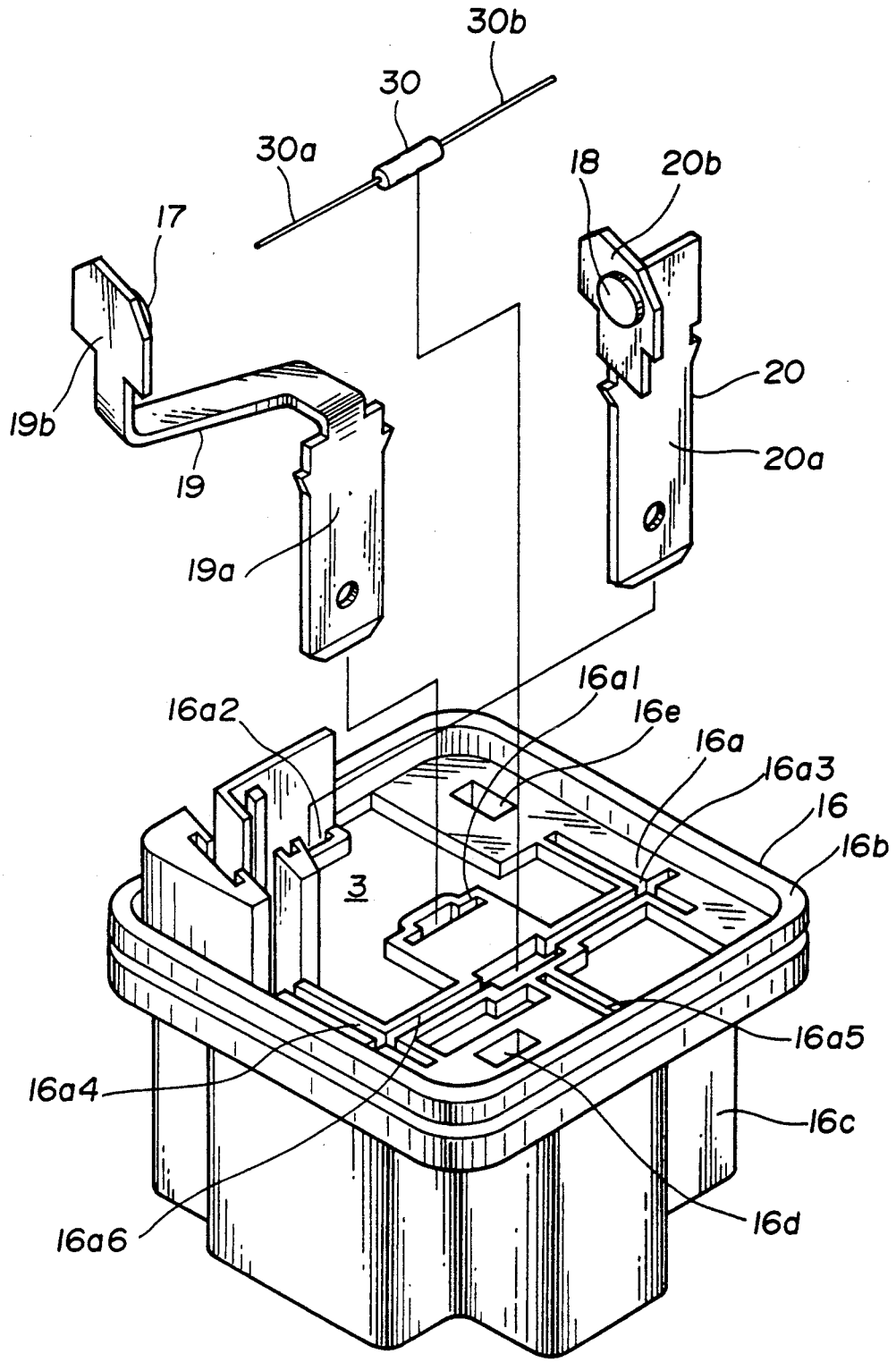

The base body 16 is provided with a case-fitting part 16b formed in a frame-like shape on a base plate 16a and provided with a connector part 16c having a box-like shape for covering the legs of the respective terminals to be connected with outer circuits on the under side of the base plate 16a as shown in FIGS. 5, 6 and 17.

The base body 16 is provided with fixed contact terminal slots 16a1 and 16a2 in the base plate 16a as shown in FIG. 17, and so structured as to fix the fixed contact terminals 19 and 20 by pressing legs 19a and 20a of the terminals 19 and 20 into the fixed contact terminal slots 16a1 and 16a2. The fixed contact terminals 19 and 20 are sited so that contact faces 19b and 20b formed at the top ends of the respective fixed contact terminals 19 and 20 may be erected on the base plate 16*a* at a predetermined distance, and the fixed contacts 17 and 18 are disposed on the contact faces 19*b* and 20*b* so as to facing each other.

Figure 18:
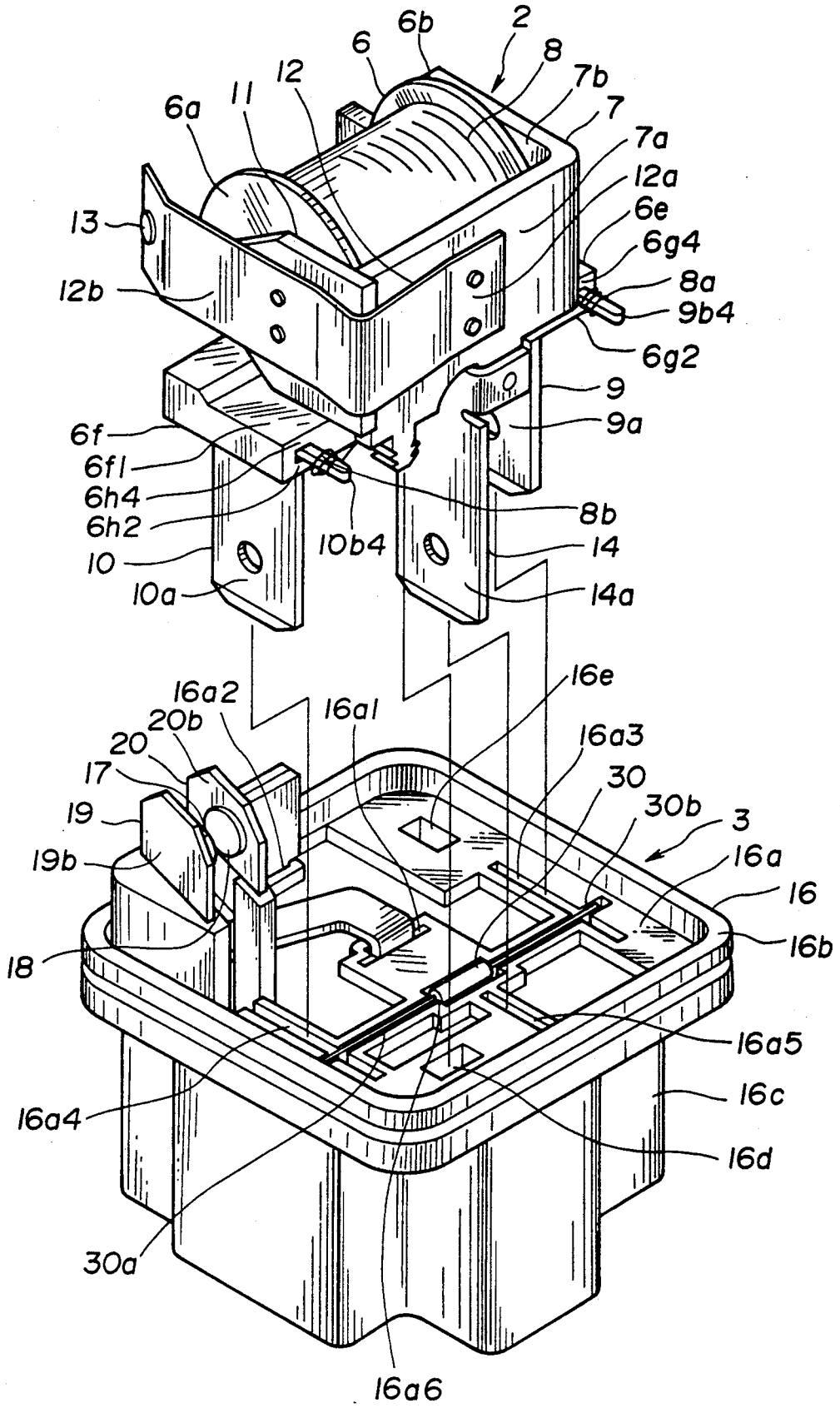

The base body 16 is provided with press-fitting holes 16*d* and 16*e* in the base plate 16*a* for supporting the frame 7 by fitting the press-fitting projections 7*a*1 and 7*b*1 of the frame 7 into them, and further provided with coil terminal slots 16*a*3, 16*a*4 and a movable contact terminal slot 16*a*5 in the base plate 16*a* for receiving the legs 9*a*, 10*a* and 14*a* of the respective terminals 9, 10 and 14 as shown in FIGS. 17 and 18.

Furthermore, the base body 16 is provided with a resistor groove 16*a*6 crossing orthogonally with the both coil terminal slots 16*a*3 and 16*a*4 on the base plate 16*a* in order to receive the resistor 30 for absorbing surge voltage at the time of stopping the excitation of the coil 8. The resistor 30 is so set in the resistor groove 16*a*6 as to lay its lead wires 30*a* and 30*b* across the coil terminal slots 16*a*3 and 16*a*4 as shown in FIG. 18. Additionally, as shown in FIG. 6, the projections 9*b*2 and 10*b*2 of the coil terminals 9 and 10 are so designed as to fit into end portions 16*a*7 and 16*a*8 on the right sides of the coil terminal slots 16*a*3 and 16*a*4 exceeding the resistor groove 16*a*6 in FIGS. 17 and 18.

The resistor 30 placed in the resistor groove 16*a*6 on the base plate 16*a* of the base 3 is connected with the coil terminals 9 and 10 by merely inserting the coil terminals 9, 10 and the fixed contact terminal 14 of the actuating part 2 in the base 3 since the lead wires 30*a* and 30*b* of the resistor 30 are fitted into the slits 9*b*3 and 10*b*3 formed between the legs 9*a*, 10*a* and the projections 9*b*2, 10*b*2 of the coil terminals 9, 10 simultaneously with inseting the legs 9*a*, 10*a* and 14*a* of the respective terminals 9, 10 and 14 into the coil terminal slots 16*a*3, 16*a*4 and the fixed contact terminal slot 19*a*5 formed in the base plate 16*a* of the base 3. At this time, the frame 7 of the actuating part 2 is also secured on the base 3 by pressing the press-fitting projections 7*a*1 and 7*b*1 of the frame 7 into the press-fitting holes 16*d* and 16*e* formed in the base plate 16*a* of the base 3.

Figure 7:
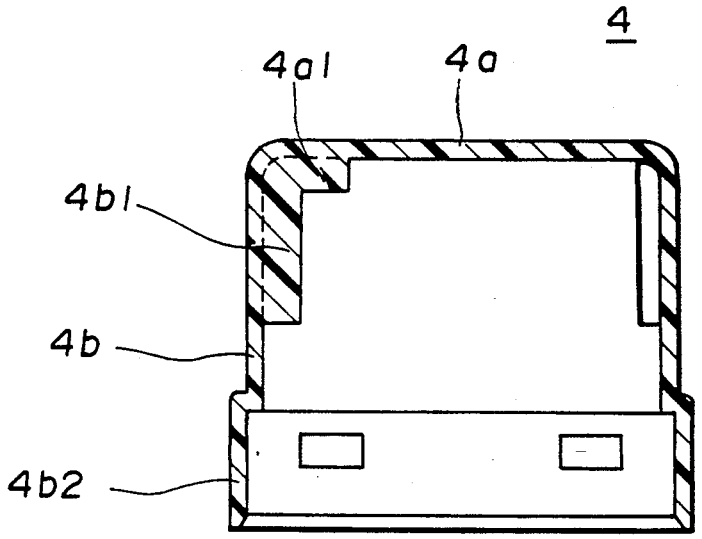
FIG. 7 is a sectional front elevation illustrating the case of the electromagnetic relay shown in FIG. 1.
Figure 8:
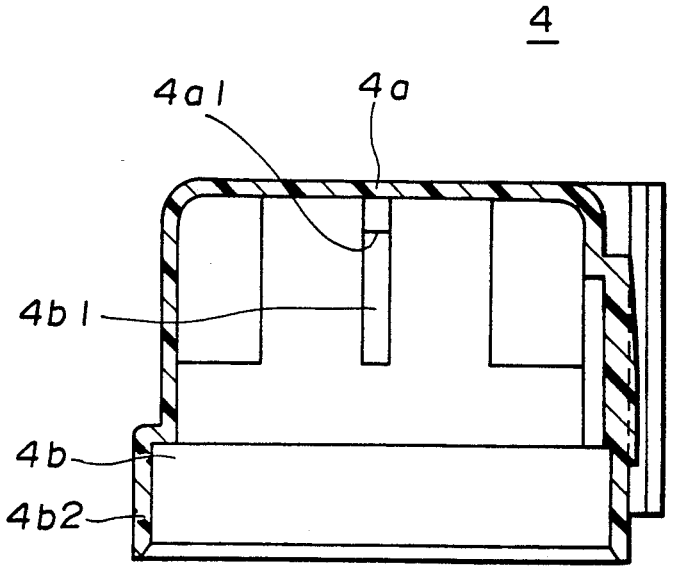
FIG. 8 is a sectional side elevation of the case shown in FIG. 7.

The case 4 is formed in a box-like shape having a top wall 4*a* and side walls 4*b* as shown in FIGS. 7 and 8, and so formed as to be coupled with the base body 16 of the base 3 by fitting a fitting part 4*b*2 formed at the lower end of the side walls 4*b* onto the case-fitting part 16*b* of the base body 16.

Figure 2:
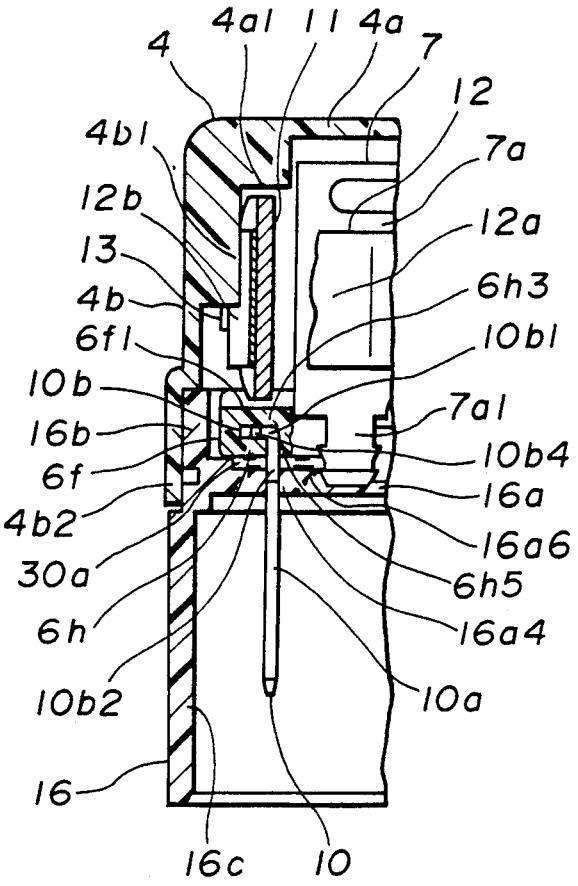
FIG. 2 is a partially sectional front elevation in the vicinity of the armature of the electromagnetic relay shown in FIG. 1.

The case 4 is provided with the first restricting face 4*a*1 parallel with the top wall 4*a* and the second restricting face 4*b*1 parallel with the side wall 4*b* on a A lip projecting step-wise from the top wall 4*a* and the side wall 4*b* as shown in FIGS. 7 and 8. The restricting faces 4*a*1, 4*b*1 including 6*f*1 of the bobbin 6 are spaced small distances away from the armature 11 at a state in which the case 4 is fitted on the base body 16 of the base 3 as shown in FIGS. 1 and 2, and prevent the armature 11 and the resilient piece 12 having the movable contact 13 from the slippage. Therefore, the electromagnetic relay 1 according to this invention is structured so as not to cause contact fault even if the relay 1 receives a heavy impact by some reason.

The electromagnetic relay 1 having the aforementioned structure may be manufactured through process steps as shown in FIGS. 12 to 18.

Figure 13:
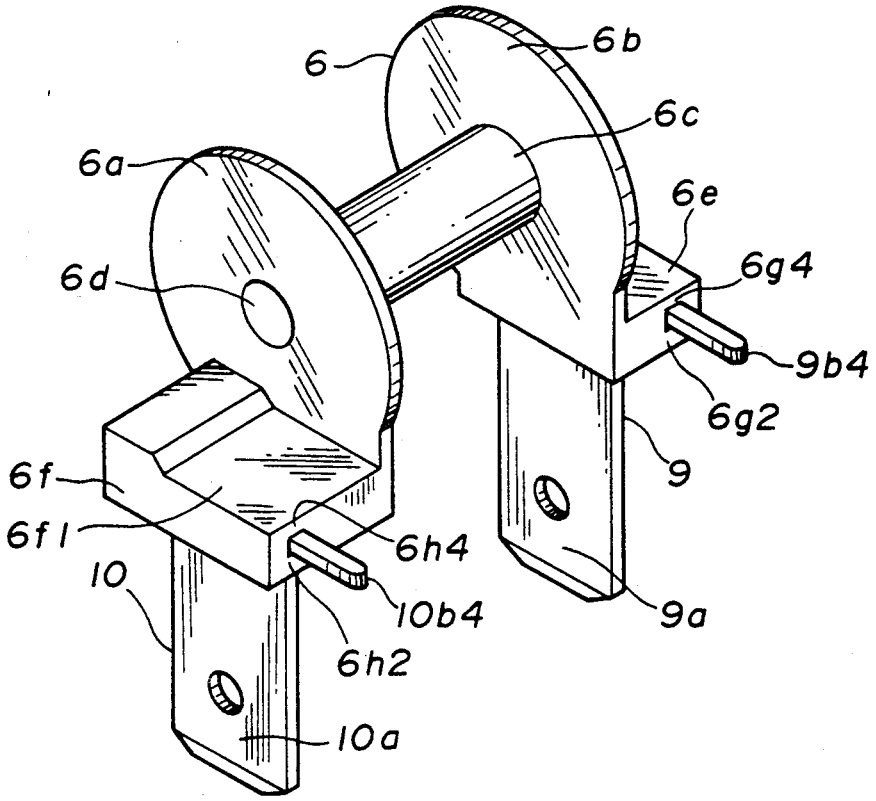

First of all, the actuating part 2 is assembled. Namely, the coil terminals 9 and 10 are attached to the bobbin 6 by inserting the inset portions 9*b* and 10*b* of the coil terminals 9 and 10 into the terminal holder grooves 6*g*3 and 6*h*3 formed in the terminal fixative parts 6*g* and 6*h* of the bobbin 6 as shown in FIG. 12. Whereby, the coil terminals 9 and 10 are secured with the bobbin 6 in the state where the legs 9*a*, 10*a* and the long projections 9*b*4 and 10*b*4 stick out from the base blocks 6*e* and 6*f* of the bobbin 6 as shown in FIG. 13.

Secondly, the coil 8 is formed by winding the wire around the cylindrical part 6*c* of the bobbin 6 secured with the coil terminal 9 and 10, and the ends 8*a* and 8*b* of the wire of the coil 8 are bound and soldered to the projections 9*b*4 and 10*b*4 of the coil terminals 9 and 10.

Next, the bobbin 6 formed with the coil 8 is attached to the frame 7 by caulking the base end of the iron core 5 passing through the bobbin 6 in the coil-side part 7*b* of the frame 7 as shown in FIG. 14.

Figure 15:
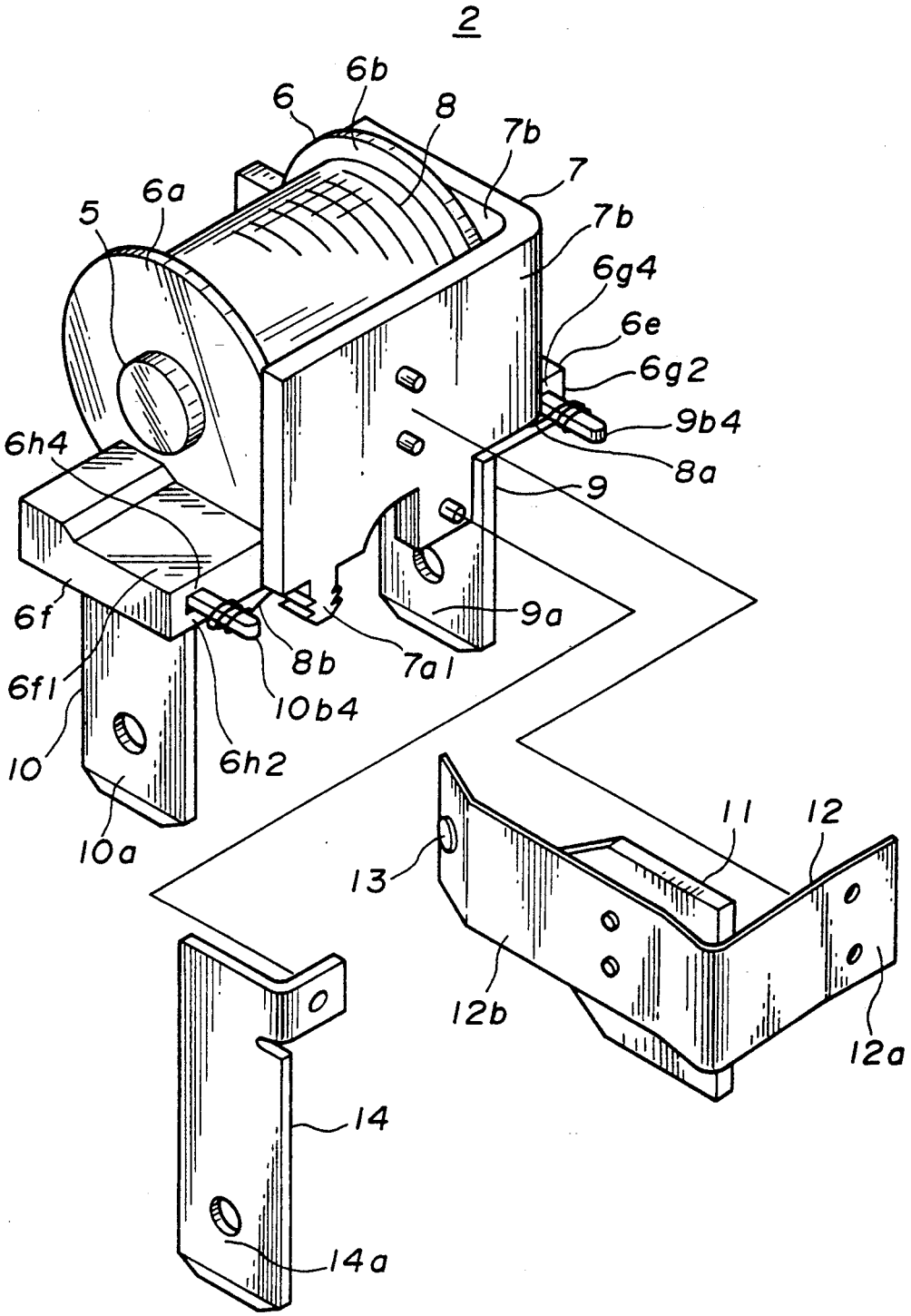
Figure 16:
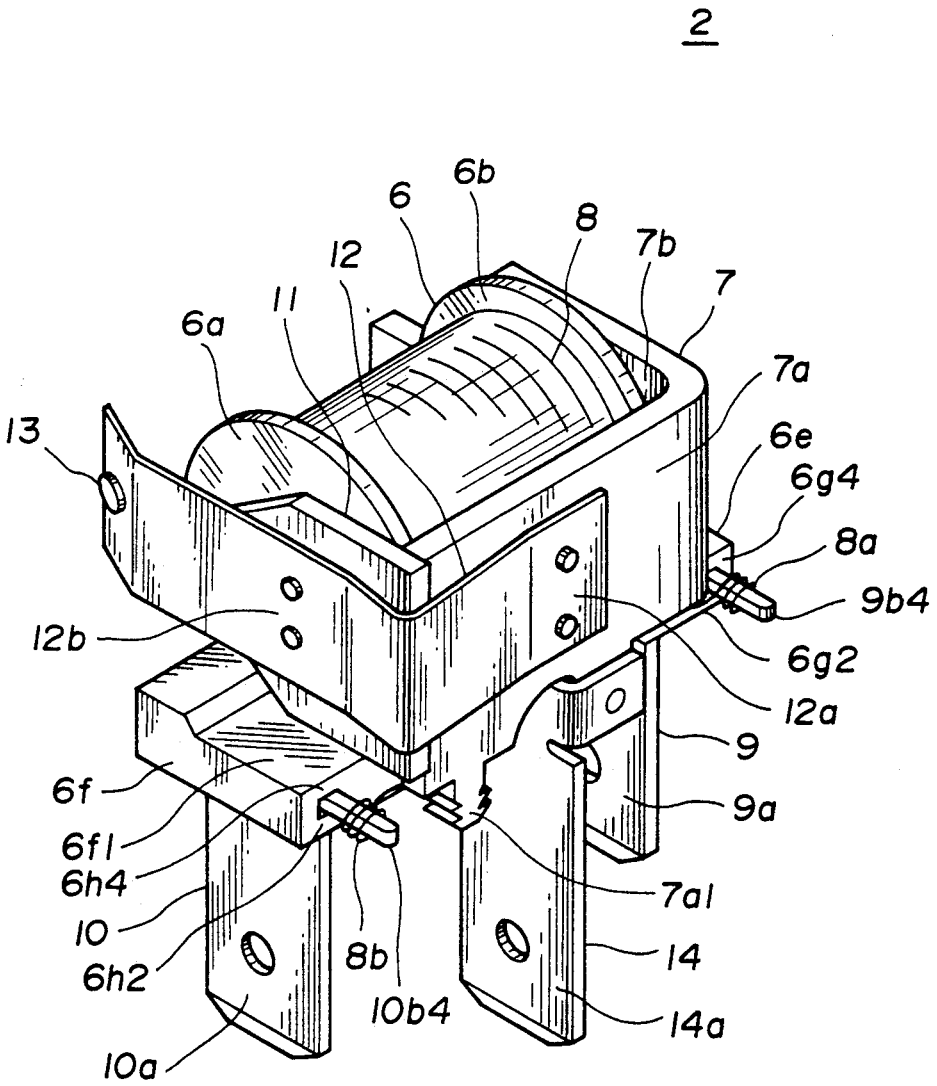

Subsequently, the resilient piece 12 disposed with the armature 11 and the movable contact 13 and the movable contact terminal 14 are secured on the armature-side part 7*a* of the frame 7 fixed to the bobbin 6 as shown in FIG. 15. Whereby, the actuating part 2 of the electromagnetic relay 1 is completed as shown in FIG. 16.

On the other side, the base 3 is assembled by pressing the legs 19*a* and 20*a* of the fixed contact terminals 19 and 20 having the fixed contacts 17 and 18 into the fixed contact terminal slots 16*a*1 and 16*a*2 formed in the base plate 16*a* of the base body 16 as shown in FIG. 17. The base 3 may be also formed in one body by uniting the fixed contacts 17 and 18 with the base body 16 using insert molding process.

Next, the resistor 30 is placed in the resistor groove 19*a*6 formed on the base plate 16*a* of the base body 16 so as to lay the lead wires 30*a* and 30*b* across the coil terminal slots 16*a*3 and 16*a*4 formed in the base plate 16*a* as shown in FIGS. 17 and 18.

Subsequently, the actuating part 2 is mounted on the base body 16 of the base 3 by inserting the legs 9*a*, 10*a* and 14*a* of the coil terminals 9, 10 and the movable contact terminal 14 protruding from the bobbin 6 of the actuating part 2 into the coil terminal slots 16*a*3, 16*a*4 and the movable contact terminal slot 16*a*5 formed in the base plate 16*a* of the base body 16 as shown in FIG. 18. In this time, the resistor 30 is connected with the coil terminals 9 and 10 in the state where the lead wires 30*a* and 30*b* of the resistor 30 are fitted in the slits 9*b*3 and 10*b*3 formed between the legs 9*a*, 10*a* and the projections 9*b*2, 10*b*2 of the respective coil terminals 9, 10, since the projections 9*b*2 and 10*b*2 are also inserted into the end portions 16*a*7 and 16*a*8 of the coil terminal slots 16*a*3 and 16*a*4, and the lead wires 30*a* and 30*b* are laid across the coil terminal slots 16*a*3 and 16*a*4 at the positions to coincide with the slits 9*b*3 and 10*b*3 of the coil terminals 9 and 10.

Then, the movable contact 13 disposed on the resilient piece 12 of the actuating part 2 is sited between the fixed contacts 17 and 18 disposed on the fixed contact terminals 19 and 20 of the base 3 so as to be in contact with the fixed contact 17 according to elastic force of the resilient piece 12, and the actuating part 2 of the relay 1 is fixed with the base 3 by inserting the press-fitting projections 7*a*1 and 7*b*1 of the frame 7 into the press-fitting holes 16*d* and 16*e* formed in the base plate 16*a* of the base 3 by force.

Finally, the electromagnetic relay 1 is completed by fitting the fitting part 4*b*2 of the case 4 onto the case-fitting part 16*b* provided on the base body 16 of the base 3.

Explanation will be given below abount the action of the electromagnetic relay 1 having the aforementioned structure.

Namely, the legs 9*a* and 10*a* of the coil terminals 9 and 10 are connected with a power circuit having switching means (not shown) for supplying an electric current to the coil 8, a first circuit (not shown) is connected between the leg 14*a* of the movable contact terminal 14 and the leg 19*a* of the fixed contact terminal 19, and a second circuit (not shown) is connected between the leg 14*a* and the leg 20*a* of another fixed contact terminal 20.

In a case the coil 8 is not excited by switching off the switching means of the power circuit, the movable contact 13 is in contact with the fixed contact 17 by the elastic force of the resilient piece 12, therefore the first circuit connected between the movable contact terminal 14 and the fixed contact terminal 19 is closed and the second circuit connected between the movable contact terminal 14 and the fixed contact terminal 20 is opened.

By changing the switching means of the power circuit in the on-state, the coil 8 is excited and the iron core 5 attracts the armature 11 according to the magnetic force generated by the excitation of the coil 8. In accordance with the attractive movement of the armature 11, the resilient piece 12 moves toward the iron core 5 together with the armature 11 and the movable contact 13 shifts from the fixed contact 17 to another fixed contact 18, thereby opening the first circuit connected between the movable contact terminal 14 and the fixed contact terminal 19 and closing the second circuit connected between the movable contact terminal 14 and the fixed contact terminal 20.

As mentioned above, in the electromagnetic relay and method for manufacturing the electromagnetic relay according to this invention, it is possible to connect the resistor with the coil terminals by fitting the lead wires of the resistor into the slits formed in the respective coil terminals at the same time the actuating part of the relay having the coil, the contacts and so on is mounted on the base. Therefore it is possible to reduce the manpower required for connecting the resistor to the coil terminals, and an excellect effect can be obtained in that the manufacturing process of the electromagnetic relay is remarkably rationalized.

What is claimed is:

1. An electromagnetic relay with a resistor comprising:

a coil assembly including a coil bobbin having a first flange provided with a first base block, a second flange provided with a second base block, a cylindrical portion supporting the first and second flanges, a coil wound around the cylindrical portion, a first coil terminal connected with a first end portion of the coil and supported on the first base block of the first flange, a second coil terminal connected with a second end portion of the coil and supported on the second based block of the second flange, and a resistor having oppositely extending lead wires connected with the first and second coil terminals;

an electromagnetic assembly including an L-shaped armature frame made of magnetic substance with electric conductivity having first and second press-fitting projections, an iron core disposed through the cylindrical portion of the coil bobbin and supported on the armature frame with the coil bobbin, an L-shaped resilient member with electric conductivity fixed on the armature frame and provided with a movable contact thereon, an armature supported on the resilient member and disposed opposite the iron core, and a terminal for the movable contact fixed on the armature frame;

a base having a base plate provided with slots receiving the first and second coil terminals and the movable contact terminal, and having a fixed contact terminal with a fixed contact thereon; and a box-shaped case coupled with the base for enclosing the coil bobbin assembly and the electromagnetic assembly;

said base being provided with a resistor groove crossing orthogonally with the slots for the first and second coil terminals;

each of said first and second coil terminals being provided with a first short projection defining a slit in which each lead wire of the resistor is secured and a second long projection being connected with each end portion of the coil; and each of said first and second base blocks of said first and second flanges of said coil bobbin being provided with a coil terminal bobbin groove receiving each of said first and second coil terminals and an aperture through which the second long projection of each of said first and second coil terminals projects.

2. An electromagnetic relay as set forth in claim 1, wherein one of said first and second base blocks of said first and second flanges of said coil bobbin is provided with an upper surface having means to restrict excessive movement of said armature toward said base block when said relay receives an impact.

3. An electromagnetic relay as set forth in claim 1, wherein said case is provided with a top wall and a side wall with an L-shaped projecting portion on an inner surface thereof to restrict excessive movement of said armature toward the top wall and the side wall of the case.

4. A method for manufacturing an electromagnetic relay with a resistor comprising the steps of:

providing a coil bobbin having a pair of first and second flanges provided with first and second base blocks, and a cylindrical portion supporting the first and second flanges;

fixing a pair of coil terminals provided with a first short projection defining a slit and a second long projection to the first and second base blocks;

winding a coil around the cylindrical portion of the coil bobbin and connecting the end portion of the coil with each of said second long projections of the pair of coil terminals;

fixing an L-shaped armature frame to the coil bobbin and inserting an iron core through the cylindrical portion of the coil bobbin;

fixing a resilient member provided with a movable contact and an armature to the armature frame and fixing a terminal for the movable contact to the armature frame;

providing a base having a fixed contact terminal with a fixed contact and a base plate provided with a pair of slots for receiving said terminals and a resistor groove extending between and intersecting said slots;

setting the resistor in the resistor groove of the base plate of the base; and mounting the assembly of the coil bobbin, the terminals, the coil, the armature frame and resilient member on the base and simultaneously connecting the lead wires of the resistor with the coil terminals by fitting the respective lead wires into the slits in the pair of coil terminals upon inserting said terminals into said slots.

5. A method for manufacturing an electromagnetic relay with a resistor as set forth in claim 4, wherein the method further comprises the step of:

coupling a box-shaped case provided with an L-shaped projecting portion on an inner wall with the base to position said L-shaped projection portion to restrict excessive movement of said armature toward the wall when said relay receives an impact.

* * * * *